US006191696B1

(12) United States Patent
Young et al.

(10) Patent No.: US 6,191,696 B1
(45) Date of Patent: Feb. 20, 2001

(54) ALARM SYSTEM FOR HAND-HELD CHEMICAL MONITOR

(75) Inventors: Randy S. Young, Belcamp; Robert L. Gross, Forest Hill; Mark S. Schlein, Abingdon; Peter J. Schlitzkus, Baltimore; Vincent K. Younger, II, Bel Air, all of MD (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/233,255

(22) Filed: Jan. 19, 1999

(51) Int. Cl.[7] ..... G08B 17/10

(52) U.S. Cl. ..... 340/632; 340/627; 340/603; 340/633; 340/634; 340/691.1; 340/692

(58) Field of Search ..... 340/603, 627, 340/632, 633, 634, 691.1, 692, 693.9, 693.12, 573.1; 439/358

(56) References Cited

U.S. PATENT DOCUMENTS 3,864,628 * 2/1975 Klass et al. ..... 324/71 SN
4,578,586 * 3/1986 Preston ..... 250/382
4,668,940 * 5/1987 Beard et al. ..... 340/521
4,745,399 * 5/1988 Kimura ..... 340/521
4,943,929 * 7/1990 Simonoff ..... 364/496
5,484,979 * 1/1996 Gao ..... 219/121.64
5,554,846 * 9/1996 Regiec et al. ..... 250/288
5,670,932 * 9/1997 Kizima ..... 340/384.06

* cited by examiner

*Primary Examiner*—Daniel J. Wu
*Assistant Examiner*—Tai T. Nguyen
(74) *Attorney, Agent, or Firm*—Ulysses John Biffoni; Vincent J. Ranucci

(57) ABSTRACT

An alarm system for portable chemical monitors comprising a housing configured for attachment to the portable chemical monitor having a twist lock mechanical connector capable of connecting to the portable chemical monitor, at least three pins mounted within the housing that are capable of inserting into the portable chemical monitor, a circuit board electrically connected to the pins and capable of receiving electrical signals from the chemical monitor, and a ceramic disk supported within the housing having an indicator means for generating vibrational movement that provides a audible sound. A method for monitoring for the presence of chemical agents is disclosed.

20 Claims, 1 Drawing Sheet

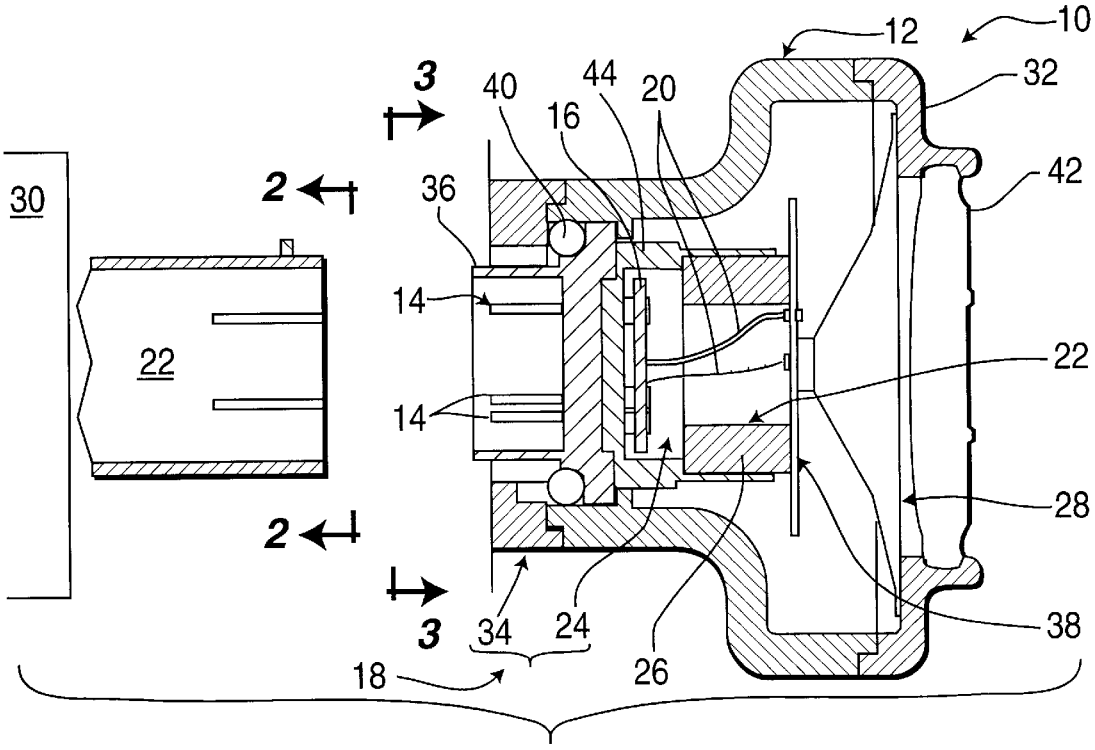
FIG. 1
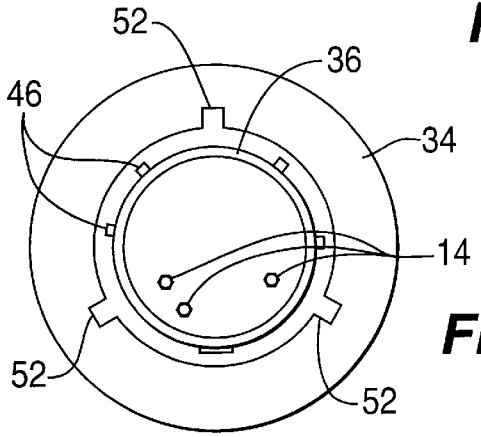
FIG. 3
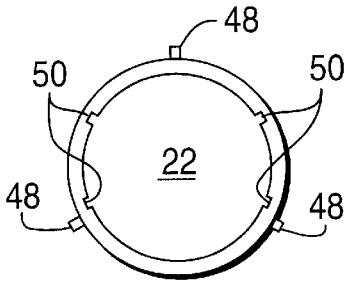
FIG. 2
FIG. 4
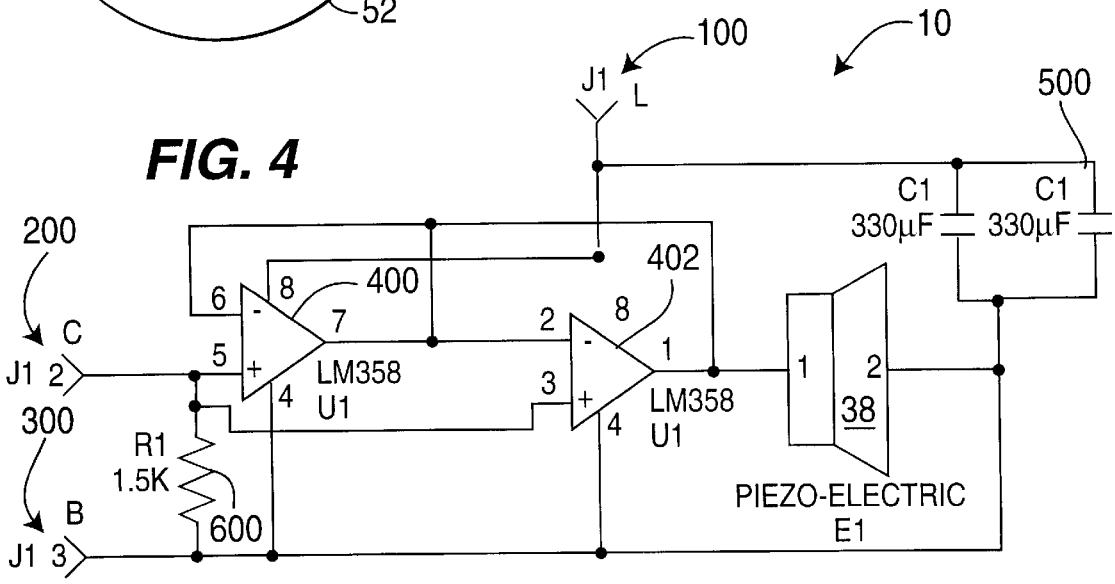

ALARM SYSTEM FOR HAND-HELD CHEMICAL MONITOR

GOVERNMENT INTEREST

The invention described herein may be manufactured, licensed, and used by or for the U.S. Government.

BACKGROUND OF THE INVENTION

1. Field of the Invention

The present invention relates to an indicator system of reduced size, weight and low power consumption for hand-held field applications. In particular, the present invention relates to an alarm system which is capable of being interfaced with portable chemical monitors. Most particularly, the present invention is an alarm system for the Chemical Agent Monitor (CAM) and Improved Chemical Agent Monitor (ICAM).

2. Brief Description of the Related Art

Today's military forces are confronted with the possibility of encountering chemical agents in battlefields. Monitoring for possible chemical contamination aids in countering the threat residual chemicals pose to exposed individuals. Constant identification of chemicals in an environment aids in the appropriate protective measures and treatment of chemical exposure.

Monitors have been used in military and civilian operations to test air quality within an area for possible chemical contamination. These monitors allow environmental sampling throughout an area of military operations or civilian use. Generally, the monitors are either mobile monitors which may be carried by individual soldiers, or area monitors placed at fixed points within an area.

Militarily, mobile monitors are important because they allow rapid monitoring of the immediate area close to soldiers, either from current or residual effects. They may be hand-held, and of various weights. This localized detection allows soldiers to react immediately to the positive detection of chemical agents. Reduced reaction time minimizes chemical exposure to soldiers within an operational area. Early detection significantly increases the chances of survival of the soldiers and the successful completion of the mission.

Several types of toxic chemical compounds are known. These include mustard and nerve agents. Mustard agents or gases, also called blister agents, may be nitrogen or chlorinated sulfur compounds. The most common type of mustard agent are the chlorinated sulfur compounds. Long after mustard gas was discovered in 1822, it was used in World War I as a chemical warfare agent, causing approximately 400,000 casualties. The sulphur mustard gas is chemically known as bis-(chloroethyl)-sulphide. The nitrogen mustard gas is chemically known as tris(2-chloroethyl)amine. Mustard gas is a colorless, oily liquid having a garlic or horseradish odor. It is slightly soluble in water, complicating removal by washing. It primarily attacks humans through inhalation and dermal contact, having an Airborne Exposure Limit (AEL) of 0.003 mg/m$^3$. Mustard gas is a vesicant and an alkylating agent which produces a cytotoxic reaction to the hematopoietic tissues. Symptoms usually begin to take effect 4 to 24 hours after initial contact. The rate of detoxification of mustard gas is slow and repeated exposure yields a cumulative effect.

Nerve agents or gases were discovered in 1936, during research on more effective pesticides. Nerve agents inhibit certain enzymes within the human body from destroying a substance called acetylcholine. This produces a nerve signal within the body forcing the muscles to contract. Nerve agents have an Airborne Exposure Limit (AEL) of 0.00001 mg/m$^3$.

Types of chemical monitors include the Chemical Agent Monitor (CAM) developed by Grasby Ionics, Inc. of Watford Herts, England, and the Improved Chemical Agent Monitor (ICAM) developed by Grasby Ionics, Inc. of Watford Herts, England, Environmental Technologies Group of Baltimore, Md. and the United States Army at Aberdeen Proving Grounds of Aberdeen, Md. The CAM or ICAM, referred to as CAM/ICAM, is carried by individual soldiers in the field and provides for detection of nerve and blister chemical agents.

There has been a long-standing need for alarm systems which are increasingly small but retain the capabilities and performance of larger-size monitors. Over the years, attempts have been made to decreased size, weight, power consumption, maintenance of the monitors, while increasing monitor speed and ease of use. Monitors should also permit the quick attachment and detachment of individual monitor parts while permitting the operators to maintain protective measures/gear integrity. Hand-held monitors become problematic with decreased sizes that are difficult to handle with protective clothing being worn.

In view of the foregoing, improvements in chemical monitoring have been desired. It has been desired to provide reduced size, weight and power requirements, while improving the durability of the monitors and the ease of field manipulations. The present invention addresses these needs.

SUMMARY OF THE INVENTION

In view of the foregoing, it is therefore an object of the present invention to provide an improved alarm system for use with hand-held chemical monitors.

It is a further object of the present invention to provide an improved alarm system having low power consumption requirements.

Additionally, it is a further object of the present invention to provide an improved alarm system that permits soldiers to easily and quickly attach and detach parts while wearing protective gear.

These and other objects are achieved by the present invention which includes an alarm system for portable chemical monitors comprising a housing configured for attachment to the portable chemical monitor having a twist lock mechanical connector capable of connecting to the portable chemical monitor, at least three pins mounted within the twist lock mechanical connector, wherein the at least three pins are capable of inserting into the portable chemical monitor, a circuit board supported within the housing and electrically connected to the at least three pins, the circuit board capable of receiving electrical signals from the chemical monitor, and, a ceramic disk comprising an indicator means for generating vibrational movement, wherein the vibrational movement provides an audible sound.

The present invention further comprises a method for monitoring for the presence of chemical agents comprising the steps of: providing an alarm system for portable chemical monitors comprising a housing configured for attachment to the portable chemical monitor having a twist lock mechanical connector capable of connecting to the portable chemical monitor, at least three pins mounted within the twist lock mechanical connector, wherein the at least three pins are capable of inserting into the portable chemical monitor, a circuit board supported within the housing and electrically connected to the at least three pins, the circuit board capable of receiving electrical signals from the chemical monitor and, a ceramic disk comprising an indicator means for generating vibrational movement, wherein the vibrational movement provides an audible sound; attaching the alarm system to the portable chemical agent monitor; transporting the portable chemical agent monitor into an operational area; and, activating the portable chemical monitor, wherein the indicator means initiates an audible alarm when the portable chemical monitor is in the presence of chemical agents.

Some of the advantages of the alarm system of the present invention include the fact that the Chemical Agent Monitor and/or the Improved Chemical Agent Monitor can be used more efficiently in the field. The alarm system for the hand-carried CAM/ICAM does not require a separate energy supply apart from the power supply from the CAM/ICAM. The alarm system can perform all functions of a full-size alarm while consuming small amounts of electrical power. The attachment for the alarm system allows easy manipulation and rapid connection and disconnection of the alarm system to the CAM/ICAM even when personnel are suited in protective clothing. Other and further advantages of the present invention are set forth in the description and appended claims.

BRIEF DESCRIPTION OF DRAWINGS

FIG. 1 is a cross-sectional view of the alarm system in accordance with the present invention;

FIG. 2 is an end view of the cylindrical connector along the 2—2 axis of FIG. 1;

FIG. 3 is an end view of the cylindrical connector along the 3—3 axis of FIG. 1; and, FIG. 4 is an electronic schematic of the alarm system of the present invention.

DETAILED DESCRIPTION OF THE PREFERRED EMBODIMENTS

The present invention is an alarm system for chemical agent monitors and method for monitoring for or indicating the presence of the chemical agents. The alarm system is capable of connecting to a hand-held, or portable, chemical agent monitor that is used in field operations for monitoring the presence of residual chemical agents within an environment. Preferably, the portable chemical monitor of the present invention is adaptable to the Chemical Agent Monitor (CAM), Improved Chemical Agent Monitor (ICAM) and/or other similar chemical agent monitoring devices. The Chemical Agent Monitor (CAM) was developed by Grasby Ionics, Inc. of Watford Herts, England, and the Improved Chemical Agent Monitor (ICAM) was developed by Grasby Ionics, Inc. of Watford Herts, England, Environmental Technologies Group of Baltimore, Md. and the United States Army at Aberdeen Proving Grounds of Aberdeen, Md. The Chemical Agent and Improved Chemical Agent Monitors are hand-held, soldier-operated, post-attack devices for monitoring chemical agent contamination on people and equipment. The monitors detect vapors of chemical agents by sensing molecular ions of specific mobilities (time of flight) and use timing and microprocessor techniques to reject interferences. The monitors also detect and discriminate between vapors of nerve and mustard agents with the capability of chemical hazard level feedback with near real-time detection of nerve and blister agents. Additionally, the monitors provide a quick determination of whether contamination exists within an environment. This increases the safety of personnel working in an environment of possible chemical contamination and reduces the need for decontamination operations. The CAM/ICAM is powered by a 6 volt power battery source, such as a single 6 volt battery or four 1.5 volt batteries.

Most preferably, the present invention is used in conjunction with the Improved Chemical Agent Monitor (ICAM). The ICAM contains a drift tube, signal processor, molecular sieve, membrane, confidence tester, dust filters, buzzer, and battery pack. The physical measurements of the ICAM are approximately 4 inches by 7 inches by 15 inches, with the ICAM weighing approximately 5 pounds. The buzzer accessory of the ICAM has a size of approximately 3.5 inches by 2.5 inches by 2.5 inches and weighs 6.5 ounces with the component battery. The buzzer is configured to use a separate nine (9) volt battery as a power source. The alarm system of the present invention replaces the need for the currently used buzzer accessory for the CAM/ICAM.

In general, the alarm system for portable chemical monitors includes the following major components (1) pins, (2) twist lock mechanical connector, (3) circuit board, (4) a power source from the CAM/ICAM, (5) ceramic disk, (6) voicemitter, and (7) housing. In particular, the alarm system includes a piezoelectric ceramic disk that requires from about 6 volts or less to produce an audible alarm or warning, with preferably from about 5 volts or less being required.

Referring now to the Figures, preferred aspects of the invention are illustrated. FIG. 1 presents a cross sectional view of the alarm system 10 of the present invention. One alarm system in accordance herewith has overall dimensions of about 1.8 inches length and 2.3 inches in diameter, and weighs about 1.7 ounces. When replacing the buzzer on the ICAM, the ICAM weighs approximately 5.1 pounds.

As seen in FIG. 1, the alarm system 10 for portable chemical monitors 30 comprises a housing 12 that is configured for attachment to the portable chemical monitor 30. The housing 12 encases component parts of the alarm system 10 and protects the component parts from physical impact and/or adverse environmental conditions. These component parts include pins 14, a circuit board 16, and a ceramic disk 38. At the side of the housing 12 opposite or furthest from the pins 14, a housing cap assembly 32 is attached. Adjacent to the chemical agent monitor 30 side of the housing 12, the housing 12 has a twist lock mechanical connector 18.

The twist lock mechanical connector 18 comprises a plug 36, an o-ring 40, and an attached locking ring 34. The plug 36 has alignment keys 46 which mate with the keyways 50 on the cylindrical connector 22 on the CAM/ICAM 30. This allows for proper alignment of pins 14. The twist lock mechanical connector 18 comprises a locking ring 34 that locks onto bayonet pin on the outside wall of the cylindrical connector 22 on the CAM/ICAM 30. The o-ring 40 seals the face of the cylindrical connector 22, and provides a compressive force to keep the alarm system 10 locked onto the CAM/ICAM 30.

The housing 12, housing cap assembly 32 and locking ring 34 are joined together with a resin chemical compound for combining plastics and/or metals, such as methylene chloride. Preferably, the housing 12, housing cap assembly 32 and locking ring 34 are manufactured from a plastic and/or metal composition that is able to withstand the forces of field operations of the chemical agent monitor 30. This includes resistance to direct impact forces equivalent to free drops of thirty (30) inches or less when attached to the chemical agent monitor 30, and continuous exposure to damp/wet environments of several weeks duration. When separated from the chemical agent monitor 30, the alarm system 10 preferably withstands free drops of from about four (4) feet or less.

FIG. 1 further shows at least three pins 14 mounted within a plug 36 on the chemical agent monitor 30 side of the housing 12. The three pins 14 provide an electrical connection from the alarm system 10 to the portable chemical agent monitor 30. Generally the CAM/ICAM 30 possesses nineteen (19) pin receptacles of which only three of these locations are needed with the present invention. The three pins 14 of the present invention minimize the degree of attachment necessary between the alarm system 10 and the CAM/ICAM 30 to properly function.

The plug 36 provides a protective encasement for the three pins 14. The pins 14 are protected from moisture and/or impact damage either while attached to the chemical agent monitor 30 or separated from the monitor 30. The alarm system 10 forms part of a protective environment for the CAM/ICAM 30 on the cylindrical connector 22. When the alarm system 10 is not attached to the CAM/ICAM 30, the cylindrical connector 22 is sealed by affixing a protective cap (not shown) thereon. The protective environment around the cylindrical connector 22 inhibits corrosion and/or leakage into the portable chemical monitor 30.

The three pins 14 are capable of inserting into the portable chemical monitor 30 and thereafter secured in place with a locking ring 34 on the outer surface of the plug 36. Preferably by having the locking ring 34 rotationally attaching the housing 12 to the portable chemical monitor 30. This rotational attachment is facilitated by the o-ring 40, that together with the plug 36 and locking ring 34, protect the circuit board 16 and other components of the alarm system 10 from moisture and/or other contaminants by sealing the environment around the twist lock mechanical connector 18 when the alarm system 10 has been placed on the chemical agent monitor 30.

The pins 14 provide input from the CAM/ICAM 30 into the alarm system 10, including power. Power supply from the CAM/ICAM 30 to the alarm system 10 is provided by the serial data output voltage such as that available from a TTL (transistor-to-transistor logic) serial communication integrated circuit chip. The ability of the present invention to function within this power limit allows the alarm system 10 to receive all necessary power directly from the CAM/ICAM 30. This removes the need for a separate power source for the alarm system 10, eliminating complexity, weight and size of the alarm system 10. Furthermore, by receiving a power supply through the pins 14, the alarm system 10 does not require additional input locations. This eliminates redundant parts, eliminates logistics of suppling extra consumable battery types, and decreases the weight load of combat soldiers monitoring for chemical agents in protective gear/clothing.

As further seen in FIG. 1, internal framing inside the housing 12 forms a compartmented matrix for protecting the component parts of the alarm system 10. This internal framing includes a moisture resistant chamber 24 adjacent to the locking ring 34 containing the circuit board 16. The circuit board 16 is supported within the housing 12 adjacent and electrically connected to the pins 14. Through the pins 14, the circuit board 16 is electrically connected to chemical agent monitor 30, and capable of receiving electrical signals from the chemical agent monitor 30. The circuit board 16 is located in the chamber 24 and sealed with electrical potting compound that fills the chamber 24. Preferably, the circuit board 16 is sealed with silicon-based potting compounds.

Two insulated wires 20 extend from the circuit board 16 to the ceramic disk 38 and an audible indicator means 28, such as a speaker element. A speaker support 44 is fixed to and holds a rubber support 26 in place. The rubber support 26 is preferably made of shock resistant/absorbing materials, such as a rubber substance, that extend through the inside of the housing 12. Support 26 anchors the ceramic disk 38 using an adhesive chemical compound, such as a cyanoacrylate manufactured by Loctite of Hartford, Conn. under the tradename Loctite Black Max. The indicator means 28 generates vibrational movement to make an audible sound, with the vibrational movement powered by the serial TTL signal of the chemical agent monitor 30. One wire 20 connects at the circuit board 16 to the ceramic disk 38 located at the center point of the speaker 28. The ceramic disk 38 conveys an input from the chemical agent monitor 30 through the pins 14 and circuit board 16 to the speaker 28, with the speaker 28 being responsive to the input from the chemical agent monitor 30. The ceramic disk 38 comprises a piezoelectric composition that is responsive to electric signals of from about 6 volts or less. The indicator means 28 may include speakers such as Part #KSN1157 Tweeter, manufactured by Motorola, Inc. of Schaumburg, Ill.

As further seen in FIG. 1, the alarm system 10 further comprises a voicemitter 42, a standard device or component of a gas mask for transmitting voice communications therethrough. The voicemitter 42 is used to convey the sound of the speaker 28, and is comprised of a polyimide diaphragm having an aluminum baffle assembly manufactured by ILC Dover of Frederica, Del. under the part name, and corresponding military designation, 5-1-1047. The voicemitter 42 is molded within the housing cap assembly 32. The alarm means provides an audible sound that is distinguishable within an area of from about ten feet or more, preferably throughout an operational area.

FIGS. 2 and 3 are end views of the cylindrical connector 22 on the chemical agent monitor 30, and the twist lock mechanical connector 18 of the alarm system 10, respectively. As seen in FIG. 2, the cylindrical connector 22 has keyways 50 along the inside of the cylindrical connector 22, and further has bayonet pins 48 along the outside of the cylindrical connector 22. FIG. 3 shows the plug 36 inside of the locking ring 34 attached to the alarm system 10. The plug 36 has alignment keys 46 which mate with the keyways 50 of the cylindrical connector 22. Additionally, the locking ring 34 forms grooves 52 for the insertion of the bayonet pins 48 of the cylindrical connector 22 on the CAM/ICAM 30. The twist lock mechanical connector 18 is inserted onto the cylindrical connector 22, with the cylindrical connector 22 fitting between the plug 36 and the locking ring 34 as the alignment keys 46 on the plug insert into the keyways 50 and the bayonet pins 48 insert into the grooves 52, with the pins 14 inserting into receptacles inside of the cylindrical connector 22. Once the cylindrical connector 22 and twist lock mechanical connector 18 are joined and positioned, the housing 12 is rotated to allow the locking ring 34 to fix and lock the position of the alarm system 10 onto the CAM/ICAM 30.

When the CAM/ICAM 30 senses the presence of a chemical agent, the indicator means 28 initiates an audible alarm in response to an electric signal from the CAM/ICAM 30 for warning of the presence of chemical contamination in an environment.

FIG. 4 illustrates an electronic schematic of the alarm system 10 of the present invention. The alarm system 10 comprises three inputs 100, 200 and 300 that represent three pin 14 connections of the alarm system 10 to the CAM/ICAM. Input 100 provides a power for audio creation of approximately 5 volts to the alarm system 10, periodically interrupted by a serial data output signal for digital data transfer. Input 200 has no power unless the CAM/ICAM senses the presence of chemical agent, which places the CAM/ICAM "in alarm". Once the CAM/ICAM is in alarm, a pulsing analog audio frequency signal of approximately 6 volts or less enters the alarm system 10 from input 200. Input 300 provides an external power supply of negative voltage, or a constant "ground" to the alarm system 10.

The circuit board 16 of the alarm system 10 contains two 7343H size surface mount capacitors 500 to store current/voltage in order to provide non-random sounds when the CAM/ICAM is in alarm. A single resistor 600 having a 1.5 KΩ resistance provides an impedance match to the CAM/ICAM. The circuit board 16 is approximately 0.65 inches in diameter, and may be custom designed for the present invention. A signal exits the circuit board 16 through insulated wires 20 to the piezoelectric ceramic disk 38, causing vibrational movement and producing an audible sound.

Dual low-power operational amplifiers (opamps) 400 and 402 are physically located on the circuit board 16. The opamps 400 and 402 amplify the voltages from input 200. When a change of voltage occurs within input 200, driving the input from input 200 to a voltage greater than that of input 300, an audible sound is produced at the piezoelectric ceramic disk 38. The alarm system 10 does not draw any current from the CAM/ICAM until the CAM/ICAM is in alarm.

The present invention further provides a method for monitoring for the presence of chemical agents. The method includes providing an alarm system 10 for portable chemical monitors 30 as described above, attaching the alarm system 10 to the portable chemical agent monitor 30, transporting the portable chemical agent monitor 30 and alarm system into an operational area and activating the portable chemical monitor 30, wherein the indicator means 28 of the alarm system 10 initiates an audible sound when the portable chemical monitor 30 is in the presence of chemical agents. The alarm system 10 may be attached to the chemical agent monitor 30 after being transported into an operational area, and may be attached to and/or detached from the chemical agent monitor 30 while in the operational area.

In operation, chemical agents are monitored by providing the chemical agent monitor 30 with an attached alarm system 10 and activating the monitor 30 to register mustard and nerve chemical agents. This involves transporting the chemical agent monitor 30 and attached alarm system 10 into an operational area by a soldier, and sweeping the area with the chemical agent monitor 30 in an on-position. The alarm system 10 produces an audible warning signal, which warns the soldiers present of specific chemical agent hazards in the environment, permitting them to take the most appropriate protective and/or defensive actions. The soldiers begin chemical agent countermeasures, such as evacuating an area, donning protective clothing, washing contaminated areas, and/or attending to medical assistance.

Table 1 provides operational data for the CAM/ICAM 30 with the alarm system 10 attached, with the previously known alarm component, and without an alarm component.

TABLE 1

OPERATING CONDITIONS FOR CAM/ICAM WITH ALARM SYSTEM ATTACHED

| Characteristic | with alarm system | with existing alarm | with no alarm |
|---|---|---|---|
| Weight (lbs): | 5.1 | 5.4 | 5.0 |
| Power Consumption (volts): | 6 | 6 | 6 |
| Size | | | |
| height (inches): | 6 | 6 | 6 |
| width (inches): | 15 | 16.5 | 13 |
| depth (inches): | 3.25 | 3.25 | 3.25 |
| Audible sound level (decibels): (at output) | 65 | 80 | NA |

The total power consumption of the indicator/alarm system 10 typically runs on 6 volts or less.

It should be understood that the foregoing summary, detailed description, and drawings of the invention are not intended to be limiting, but are only exemplary of the inventive features which are defined in the claims.

What is claimed is:

1. An alarm system for portable chemical monitors, comprising:

a housing configured for attachment to the portable chemical monitor having a twist lock mechanical connector capable of connecting to the portable chemical monitor;

at least three pins mounted within the twist lock mechanical connector, wherein the at least three pins are capable of inserting into the portable chemical monitor;

a circuit board supported within the housing and electrically connected to the at least three pins, the circuit board capable of receiving electrical signals from the chemical monitor; and, a ceramic disk comprising an indicator means for generating vibrational movement, wherein the vibrational movement provides a audible sound.

2. The alarm system of claim 1, wherein the indicator means comprises a piezoelectric composition.

3. The alarm system of claim 1, wherein the piezoelectric composition is responsive to electric signals of from 6 volts or less.

4. The alarm system of claim 1, wherein the indicator means comprises a speaker element.

5. The alarm system of claim 1, wherein the ceramic disk is mounted on rubberized supports.

6. The alarm system of claim 1, wherein the housing is rotationally attachable to the portable chemical monitor.

7. The alarm system of claim 1, wherein the housing further comprises an o-ring mechanism for rotational movement when being attached to the portable chemical monitor.

8. The alarm system of claim 1, further comprising an enclosure internally located within the housing, the enclosure containing the circuit board therein.

9. The alarm system of claim 8, wherein the enclosure provides a moisture resistant chamber.

10. The alarm system of claim 8, wherein the circuit board comprises silicon-based potting compounds.

11. The alarm system of claim 1, comprising about three pins.

12. The alarm system of claim 1, further comprising a voicemitter.

13. The alarm system of claim 1, wherein the voicemitter comprises polyimide diaphragm in aluminum housing.

14. The alarm system of claim 1, wherein the voicemitter is molded to the housing.

15. The alarm system of claim 1, wherein the portable chemical monitor comprises a Chemical Agent Monitor (CAM).

16. The alarm system of claim 1, wherein the portable chemical monitor comprises an Improved Chemical Agent Monitor (ICAM).

17. The alarm system of claim 1, wherein the indicator means initiates an alarm in response to an electric signal for warning of the presence of chemical contamination in an environment.

18. The device of claim 17, wherein the alarm means is audible within an area of from about ten feet or less.

19. The device of claim 1, wherein the alarm means is audible throughout an operational area.

20. A method for monitoring for the presence of chemical agents comprising the steps of:

providing an alarm system for portable chemical monitors, comprising a housing configured for attachment to the portable chemical monitor having a twist lock mechanical connector capable of connecting to the portable chemical monitor, a twist lock mechanical connector attached to the housing capable of connecting to a portable chemical monitor, at least three pins mounted within the twist lock mechanical connector, wherein the at least three pins are capable of inserting into the portable chemical monitor, a circuit board supported within the housing and electrically connected to the at least three pins, the circuit board capable of receiving electrical signals from the chemical monitor and, a ceramic disk comprising an indicator means for generating vibrational movement, wherein the vibrational movement provides a audible sound;

attaching the alarm system to the portable chemical agent monitor;

transporting the portable chemical agent monitor into an operational area; and, activating the portable chemical monitor, wherein the indicator means initiates an audible alarm when the portable chemical monitor is in the presence of chemical agents.

* * * * *